US005934160A

United States Patent [19]

Gibson

[11] Patent Number: 5,934,160

[45] Date of Patent: Aug. 10, 1999

[54] CORK EXTRACTOR

[75] Inventor: Jeremy H. Gibson, Eastlake, Ohio

[73] Assignee: Faye Fong Chen, Ann Arbor, Mich.

[21] Appl. No.: 09/009,777

[22] Filed: Jan. 20, 1998

[51] Int. Cl.[6] ..... B67B 7/62

[52] U.S. Cl. ..... 81/3.37; 81/3.39; 81/3.29

[58] Field of Search ..... 81/3.37, 3.35, 81/3.36, 3.39, 3.29

[56] References Cited

U.S. PATENT DOCUMENTS

| | | | |
|---|---|---|---|
| 532,575 | 1/1895 | Morgan . | |
| 644,088 | 2/1900 | Morgan . | |
| 678,773 | 7/1901 | Coomber . | |
| 776,152 | 11/1904 | Strohacker . | |
| 4,063,473 | 12/1977 | Bozzo | 81/3.37 |
| 4,253,351 | 3/1981 | Allen . | |
| 4,276,789 | 7/1981 | Allen . | |
| 4,291,597 | 9/1981 | Allen . | |
| 4,377,096 | 3/1983 | Allen . | |
| 4,677,883 | 7/1987 | Lee | 81/3.37 |
| 4,703,673 | 11/1987 | Allen . | |
| 4,727,779 | 3/1988 | Lee | 81/3.37 |
| 4,765,206 | 8/1988 | Poehlmann . | |
| 4,798,106 | 1/1989 | Foster | 81/3.29 |
| 4,800,784 | 1/1989 | Allen . | |
| 4,947,711 | 8/1990 | Giebeler | 81/3.37 |
| 5,000,063 | 3/1991 | Federighi, Sr. | 81/3.37 |
| 5,086,675 | 2/1992 | Leung . | |
| 5,220,855 | 6/1993 | Leung . | |

*Primary Examiner*—David A. Scherbel
*Assistant Examiner*—Lee Wilson
*Attorney, Agent, or Firm*—James A. Lucas

[57] ABSTRACT

A device for removing a cork from a stoppered bottle utilizes a lever and a cam to drive a helical corkscrew into a cork, to withdraw the cork, and then to strip the cork from the corkscrew. The device comprises a housing having a bell-shaped opening to be placed over the mouth of the bottle. A lever has a semi-circular gear at one end which is pivotally joined to the housing. The gear engages a reciprocating, and preferably a rotatable gear rack whereby pivotal movement of the lever causes the gear rack to move linearly up and down through the housing. The lower end of the gear rack is joined to the corkscrew the free end of which extends through a cam collar and engages a cam follower therein. The cam collar is movable vertically within the housing from a lower position to a raised position, but is restricted against rotation relative to the housing. Two or more flexible fingers have notches therein which engage and disengage corresponding projections on the cam collar. The method of operation of the device is also described.

37 Claims, 8 Drawing Sheets

CORK EXTRACTOR

BACKGROUND OF THE INVENTION

1. Field of the Invention

This invention relates to a device for extracting a cork from a bottle of wine or the like. More particularly the invention relates to a cork screw which is driven with a rotating motion into a cork which is then extracted from the bottle. The cork screw can then be unthreaded from the cork.

2. Description of the Prior Art

One device which has been developed to meet the needs for effectively and quickly removing the cork from a bottle comprises a cork screw rotatably mounted in a carrier which in turn is mounted in a frame which fits over and may be clamped to the mouth of a stoppered bottle. A handle is used to move the cork screw longitudinally through a camming device which imparts rotation to the cork screw. As the cork screw engages and is rotatably driven into the cork, the camming device is prevented from movement. Moving the handle in the opposite direction causes the camming device to become unlatched whereby the cork is extracted from the bottle and is drawn along with the camming device, into the frame. When the handle is again reversed, the camming device is re-latched, thereby causing the cork screw to be rotated and threaded out of the cork.

These prior art devices suffer from various defects and drawbacks. Some of the devices were unduly complex with as many as 20 to 40 discrete parts, thereby contributing to high manufacturing and consumer costs, and an enhanced likelihood of failure or jamming.

In other devices, the camming mechanism operates under the effect of gravity, thereby running the risk of being inadvertently engaged or disengaged.

In yet others, the mechanical latching or unlatching can occur irrespective of whether the device is engaging the mouth of a bottle.

In still others, the corkscrew must be manually threaded into and out of the cork.

BRIEF DESCRIPTION OF THE INVENTION

It is an objective of the present invention to provide a cork screw extractor having the ability to simply and reliably extract a cork from a bottle and to thereafter mechanically remove the cork from the helix of the cork screw.

Another objective is a cork extracting device which does not rely on the effects of gravity for its operation, but instead provides a positive latch mechanism for the operation of a cam.

Still another object is a cork screw device which contains a minimum of movable parts.

These and other objectives are accomplished in a manner to be hereinafter described as follows.

The present invention relates to a cork extractor comprising a generally vertically longitudinal housing having an upper portion, and a lower portion terminating in a generally bell-shaped opening, the housing containing a plurality of circumferentially spaced, downwardly facing flexible fingers. The ends of the fingers form an opening adapted to engage the mouth of a corked bottle. Within the housing is a cam collar which is non rotatable but is vertically movable between a lower latched position and a raised unlatched position. The cam collar has a vertical passageway extending therethrough, and includes a cam follower positioned in, and intercepting a portion of the passageway. Aligned above the cam collar is a gear rack movable through the housing between a first position wherein the bottom of the gear rack is spaced vertically above the cam collar and a second position wherein the bottom of the rack is adjacent to the collar. A plurality of gear teeth are evenly spaced from one another along the length of the gear rack.

A lever has one end joined to the upper portion of the housing about a pivot axis. The lever includes a semi circular gear around the pivot axis engaging the gear teeth of the gear rack and a handle at the other end whereupon pivotal movement of the handle causes rotation of the gear to impart reciprocating movement to the gear rack. A helically coiled cork screw is joined at its upper end to the bottom of the gear rack, with the free lower end adapted to enter or be threaded into the cork. The cork screw is axially aligned with a vertical passageway in the collar, and engages the cam follower to impart a rotating motion to the cork screw as it is moved linearly through the cam collar into the cork. Preferably the cork screw forms a barrel cam helix of less than about 45°.

The ends of the fingers when relaxed define an opening which is normally smaller than the outer diameter of the mouth of the bottle whereby the fingers hold the cam collar in its lower latched position. The fingers each terminate in an inwardly facing beveled surface adapted to contact the mouth of a bottle and to bias the flexible fingers radially outwardly as the fingers are moved downwardly into engagement with the mouth, thereby causing unlatching of the cam collar. Each of the fingers includes a notch which forms a radially inwardly facing latch and the cam collar includes a flange to engage the latch when the fingers are relaxed and to disengage the latch when the fingers are spread radially apart by engagement with the mouth of the bottle. The portion of the finger contacting the bottle preferably is curved to fit the contour of the bottle mouth. The fingers cooperate with the circumferential flange around the mouth of most bottles to resist removal of the cork extractor from the bottle, particularly while driving the corkscrew into the cork.

The housing includes at least one and preferably two, vertically extending key ways, and the cam collar includes a corresponding key which engages each of the key ways to prevent rotational movement of the cam collar with respect to the housing while permitting vertical movement of the cam collar along the key way slot. The handle is adapted to rotate through an arc of between about 120 degrees about 180 degrees, preferably between about 150 degrees and about 180 degrees to produce sufficient linear movement to the gear rack to permit a cork to be fully extracted from the bottle. The spiral cork screw is either secured to the rack to prevent relative rotation therebetween, or alternatively is coupled to the gear rack to permit the cork screw to rotate independently of the gear rack.

The vertical passageway through the cam collar is cylindrical and the cam follower includes a first bearing surface extending into the vertical passageway into contact with the helical surface of the cork screw as a cork screw is spirally driven into the cork. The cam follower includes a second bearing surface intercepting the vertical passageway in contact with the cork screw as the cork is removed from the cork screw. The first and second bearing surfaces of the cam follower preferably converge to form a rounded apex. The cam follower extends into the vertical passageway, typically between about ½ and about ⅔ of the diameter of the passageway, a distance which is adequate to cause camming of the helical cork screw.

The lever is pivotally joined to the housing through a pair of lugs offset from the axis of the gear rack and located at the upper portion of the housing.

The present invention also relates to a cork extractor comprising a housing having a generally bell shaped opening including a plurality of downwardly extending fingers adapted to engage the mouth of a bottle, a cam collar within the housing, vertically movable but not rotatable within the housing, the cam collar including a cam follower, and a helical corkscrew vertically movable within the cam collar. The improvement comprises the use of a gear rack joined to the upper end of the cork screw vertically and rotatably movable within the housing, the gear rack positioned above, and axially aligned with the cam collar. A semi circular gear engages the gear rack preferably through a vertical slot in the housing, whereupon pivotal movement of the lever about the semi circular gear imparts reciprocating motion to the gear rack. The cork extractor includes a single elongated lever having the semi circular gear at one end and a handle at the other end, the lever pivotally joined to the upper end of the housing between a pair of lugs. The gear rack contains a plurality of evenly spaced, discrete gear teeth along the length thereof. The gear rack is freely rotatable and the gear teeth extend circumferentially around the rack. The contact at any given time between the teeth of the semi-circular gear and the teeth on the gear rack is limited to a single tooth and preferably a single point contact.

The cork screw and gear rack my be connected together for joint rotation. Alternatively, the cork screw may be joined to the gear rack to be independently rotatable with respect thereto in which event the gear rack has an annular passageway extending therethrough. One end of the cork screw is secured to a rod extending through the annular passageway, the rod having a retaining cap at the upper end, and a circumferential slot at the lower end of the gear rack. A spring clip such as an E-clip is snapped into the slot as a retainer to limit vertical movement but not rotational movement of the cork screw with respect to the gear rack. The clip includes a plurality of cones spaced from one another in contact the bottom of the gear rack to provide a low friction contact surface to facilitate relative rotation of the cork screw with respect to the gear rack. Alternatively, the bottom of the gear rack may include downwardly facing cones spaced from one another in contact with the spring clip.

The semi circular gear of the present device has a diameter which is sufficient to linearly move the gear rack to fully extract the cork from a bottle upon movement of the handle through an arc of between about 120 degrees and about 180 degrees.

The cork extractor further comprises an elongated housing having a generally bell shaped opening at one end adapted to engage the mouth of a cork bottle. A gear rack is movable along the axis of the housing. A lever pivotally connected to the other end of the housing includes a semi circular gear engaging the gear rack. A cork screw is joined to the lower end of the gear rack. The improvement comprises a plurality of flexible fingers disposed in each slot of the bell shaped opening and adapted to engage the mouth of the cork bottle, and a cam collar axially but not rotationally movable within the housing between a first position in proximity to the mouth of the bottle and a second position spaced a sufficient distance from the first position to permit the cork to be fully extracted from the bottle. The cam collar has a latch engaging means, and each of the fingers includes latching means. The latching means comprise notches, and the latch engaging means comprises a flange or projection in the cam collar to engage each latch to restrain the cam collar from vertical movement within the housing. The notch on each finger opens radially inwardly toward the axis of the housing whereby it engages one radially outwardly extending projection on the cam collar when the collar is positioned at the bottom of its path of travel within the housing. The fingers include a beveled surface adapted to contact the mouth of the bottle and to bias the flexible fingers radially outwardly as the fingers are urged around the mouth of the bottle thereby causing the cam collar to be disengaged from the finger notches. The surface of the finger contacting the bottle preferably is curved to fit the contour of the mouth of the bottle. The latch engaging means on the cam collar comprises two flanges, each engaging the notch of the corresponding finger. The cam collar includes at least one vertically extending key, and the housing contains a corresponding key way engaged by the key to permit the cam follower to move axially but not rotationally within the housing. The fingers may be integrally molded into the housing or alternatively may be joined thereto by mechanical fastening means such as rivets, a nut and bolt or the like.

DETAILED DESCRIPTION OF THE INVENTION

Figure 1:
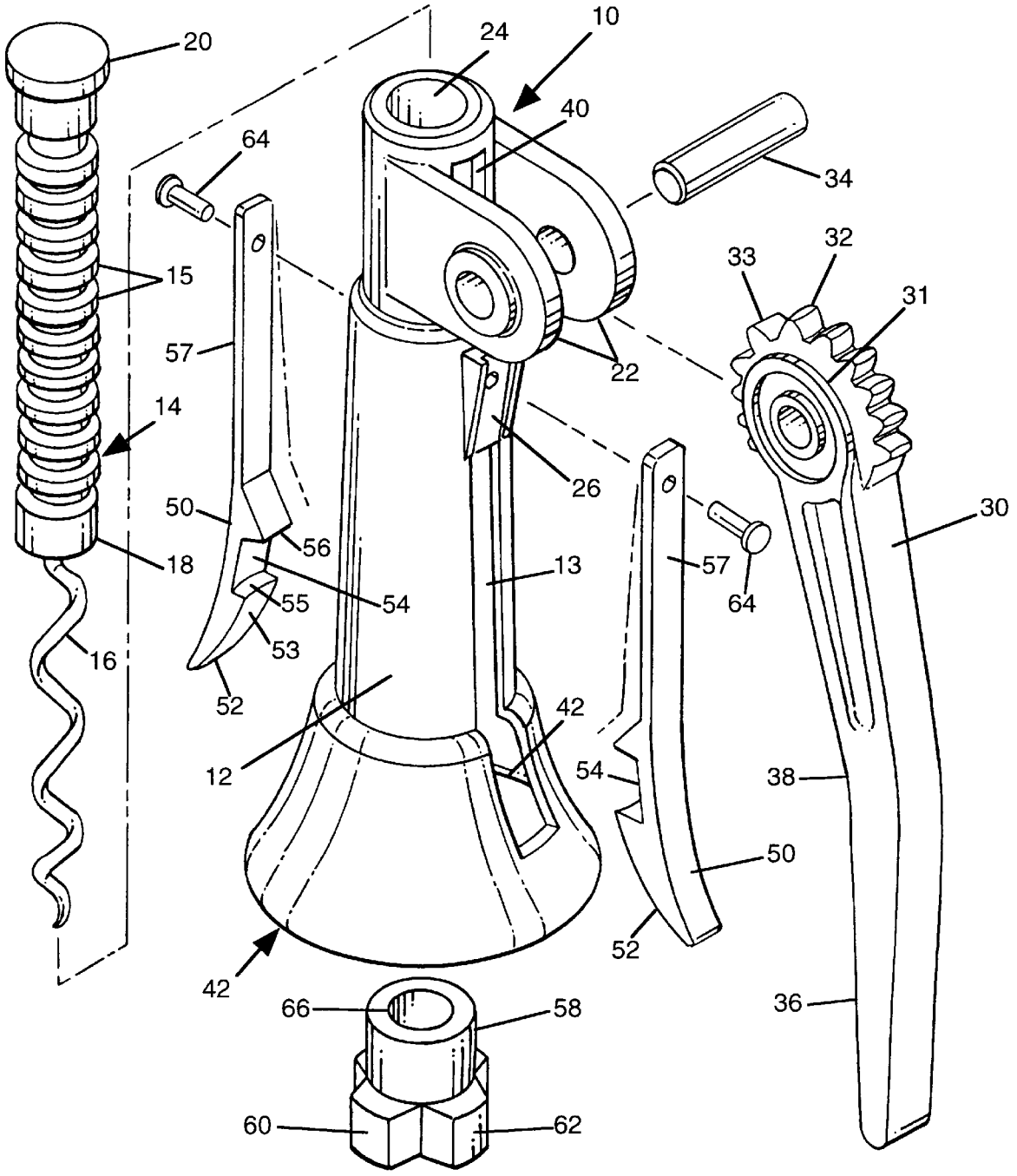
FIG. 1 is an exploded perspective view of the cork extractor of the present invention.

Referring now to the drawings, FIG. 1 shows the component parts of the cork extractor 10 of the present invention comprising a housing 12 having a vertical axis, a gear rack 14 vertically movable up and down along the axis within an annular passageway 24 extending vertically through the housing, a corkscrew 16 joined to the lower end 18 of the gear rack, and a cap 20 at the top of the gear rack.

The housing contains a pair of lugs 22 offset from the vertical axis of the passageway. A lever 30 has a rounded end 31 including a semi circular gear 32 rotatably movable between the lugs and secured thereto by a pivot pin 34. By semi circular is meant that the gear teeth 33 extend at least about 120° but typically less than 240° around the circumference of the rounded end. The gear extends through a slot 40 in the housing 12 where it engages the teeth 15 of the gear rack 14. The other end of the lever preferably forms a handle 36. The lever contains a bend 38 which places the handle parallel to the housing 12 when the lever is in the lowered position, thereby facilitating the manipulation of the cork extractor. Having the fulcrum of the lever offset from the vertical axis of the gear rack provides a distinct mechanical advantage to the user when driving the corkscrew into the cork and removing the cork from the bottle.

Figure 2:
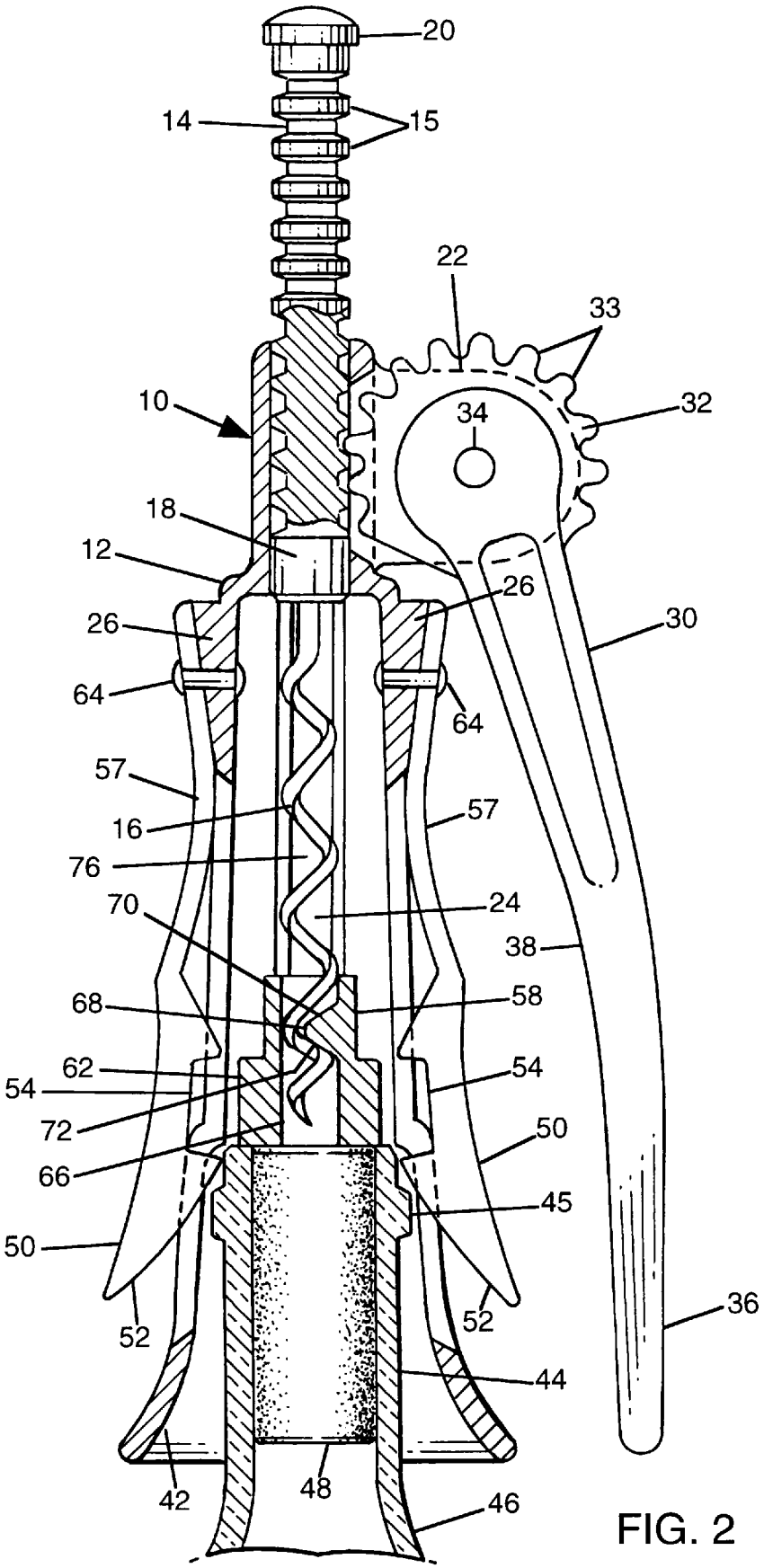
FIG. 2 is a sectional view of the extractor, partially in cross-section, placed over the mouth of a stoppered bottle.

The lower end of the housing 12 terminates in a bell-shaped opening 42 which is adapted to engage the mouth 44 of a bottle 46 such as a wine bottle stoppered with a cork 48 as seen in FIG. 2. Most corked bottles also include a flange 45 around the mouth. The housing also includes a pair of fingers 50 which are spring loaded and which terminate in an inwardly facing beveled surface 52. The surfaces serve to spread the fingers apart as the bell-shaped opening is slipped over the mouth of a bottle. Each finger has a notch 54 adapted to engage and latch with a flange or projection 62 of cam collar 58. The surface of the fingers below the notch has a curvature 53 which corresponds generally to the diameter of the bottle neck. The notch includes a lower shoulder 55 and upper shoulder 56. The notch is formed along the radial inner surface of the finger by molding, machining or other suitable technique known in the art. The upper end 57 of the fingers are secured to a wedge-shaped lug 26 on the housing 12 by rivets 64, nuts and bolts, or other suitable fastening means. Each finger fits in a slot 13 in the housing 12. Alternatively, the fingers may be formed with one end joined as an integral part to the housing which typically is made by injection molding a structural polymer such as nylon, Delrin, ABS, polypropylene or the like.

Figure 7:
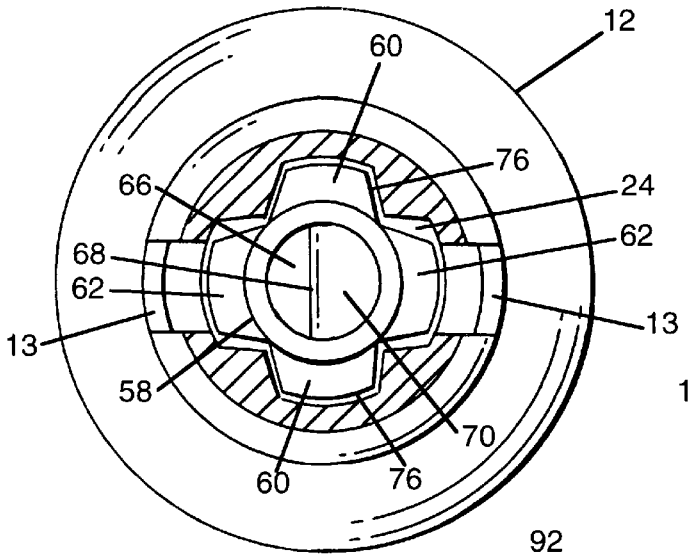
FIG. 7 is an enlarged cross-sectional view taken along lines 7—7 of FIG. 6.

The cam collar 58 cooperates with the housing 12 such that the collar moves linearly and vertically within the passageway 24 through the housing but is restricted against rotational movement. As shown in FIG. 7, the cam collar includes two opposed sets of laterally extending projections 60, 62. The first set of projections 60 form keys which cooperate with vertical grooves or key ways 76 along the passageway in the housing to prevent the relative rotation while the second set 62 engage the finger notches 54 when the fingers are in their normal relaxed position, i.e. are not spread apart from one another by engagement with the mouth of a bottle.

The cam collar 58 contains a vertical passageway 66 through which the spiral corkscrew 16 passes. A cam follower 68 intercepts the passageway and contains a first beveled surface 70 and a second beveled surface 72 against which the corkscrew is cammed and caused to rotate as the corkscrew moves down and up through the passageway. The two beveled surfaces are in the shape of a chisel, converging to form a rounded apex.

The diameter of the semi circular gear 32 at the end of the lever 30 is selected so that rotation of the lever through a pre-selected arc, e. g. between 120 degrees and 180 degrees will cause the gear rack to move between its upper and lower most positions. For example rotation of a 2 inch diameter gear through a 180 degree arc will reciprocate the gear rack through a stroke of about 3.14 inches.

The cork extractor operates in the following manner. As shown in FIG. 2, the bell-shaped opening 42 of the cork extractor 10 is slipped over the mouth 44 of a bottle 46 with the handle 36 in the lowered position and the gear rack 14 and the corkscrew 16 elevated. The fingers 50 engage the mouth and are biased away from one another causing them to be unlatched from the flanges 62 of the cam collar 58.

Figure 3:
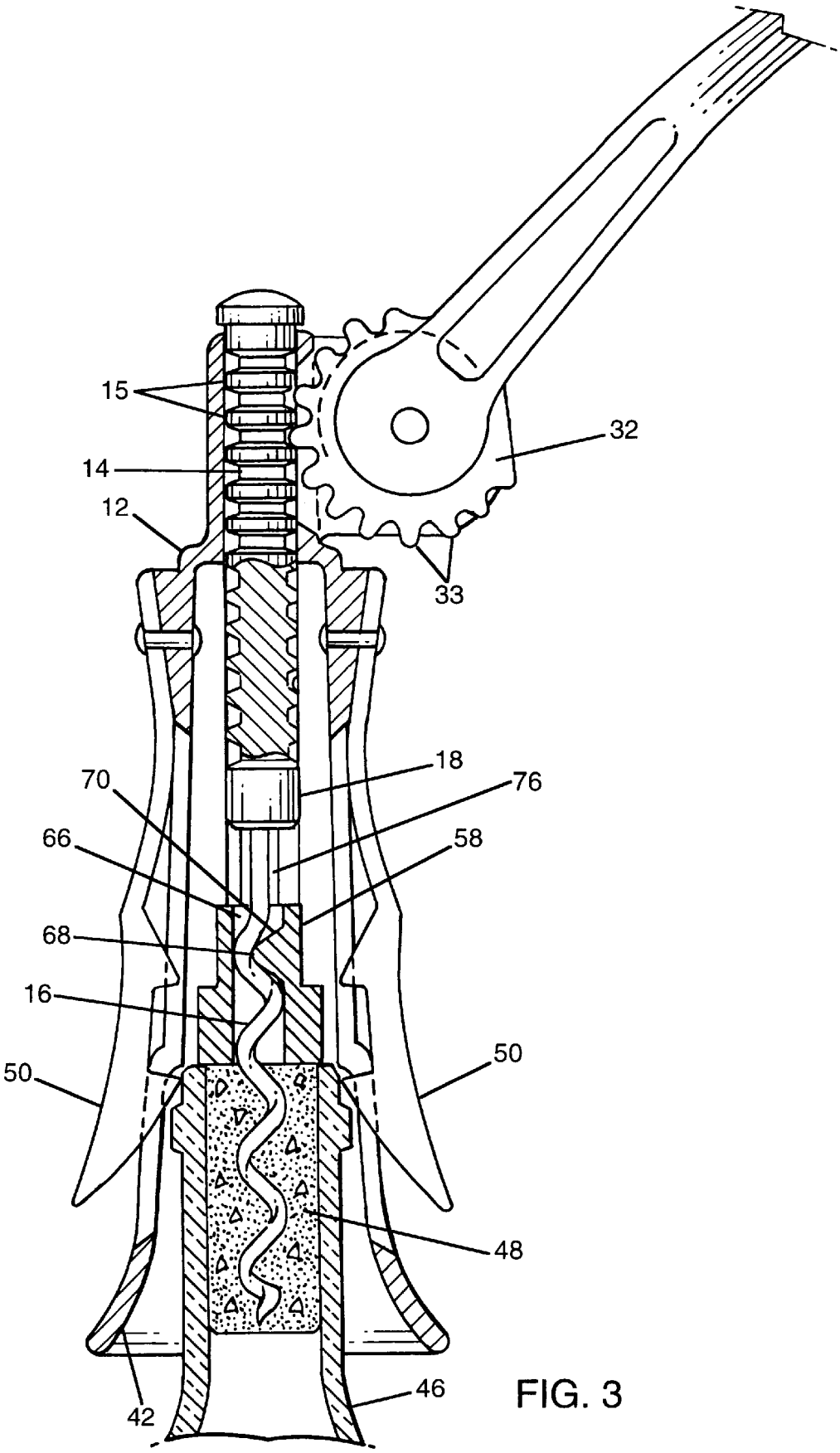
FIG. 3 is partial cross-section of the extractor with the handle up and the corkscrew in the cork.

Turning to FIG. 3, the handle of the lever is rotated from its lowered position through an arc of between about 120° and about 180° to a raised position. This pivotal rotation thereby causes the teeth 33 of the semi circular gear 32 to drive the gear 15, and thus, the gear rack 14, linearly downwardly into the housing 12. The spiral corkscrew 16 attached to the lower end of the gear rack passes through the vertical passageway 66 in the cam collar 58 where contact with the first beveled surface 70 of the cam follower 68 causes the corkscrew and the gear rack to rotate as they move downward. This downward spiral movement of the corkscrew causes it to enter and become embedded in the cork 48 as the bottom 18 of the gear rack approaches and becomes contiguous with the top of the cam collar, thereby arresting further downward movement of the corkscrew. By contiguous is meant that the bottom of the rack contacts the cam collar or comes to rest close to the collar at the bottom of the stroke.

Figure 4:
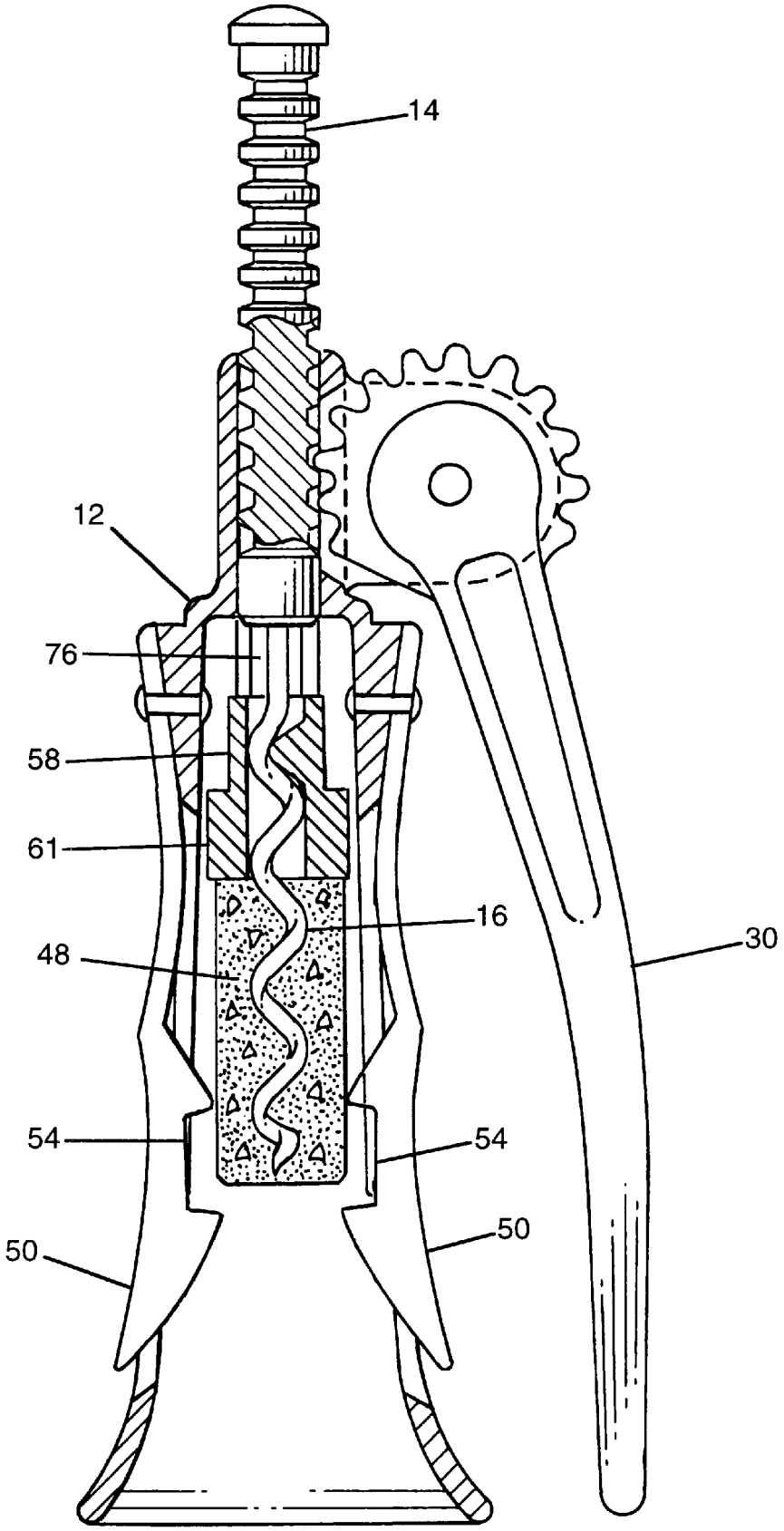
FIG. 4 is an elevational view, of the device, partially in cross-section, with the handle down and the cork removed from the bottle.

FIG. 4 shows the next step in the cork removal as the lever 30 is rotated down from its fully raised position to the fully lowered position. During this step, the cork 48 is drawn vertically out of the mouth of the bottle as the gear rack 14, corkscrew 16, cam collar 58, and cork 48 all move vertically upwardly through the housing 12. The cam collar is free to move vertically within the housing when it is unlatched from the fingers. The vertical movement is sufficient to completely withdraw the cork from the bottle, thereby obviating the necessity of twisting and pulling the extractor to complete the removal.

Figure 5:
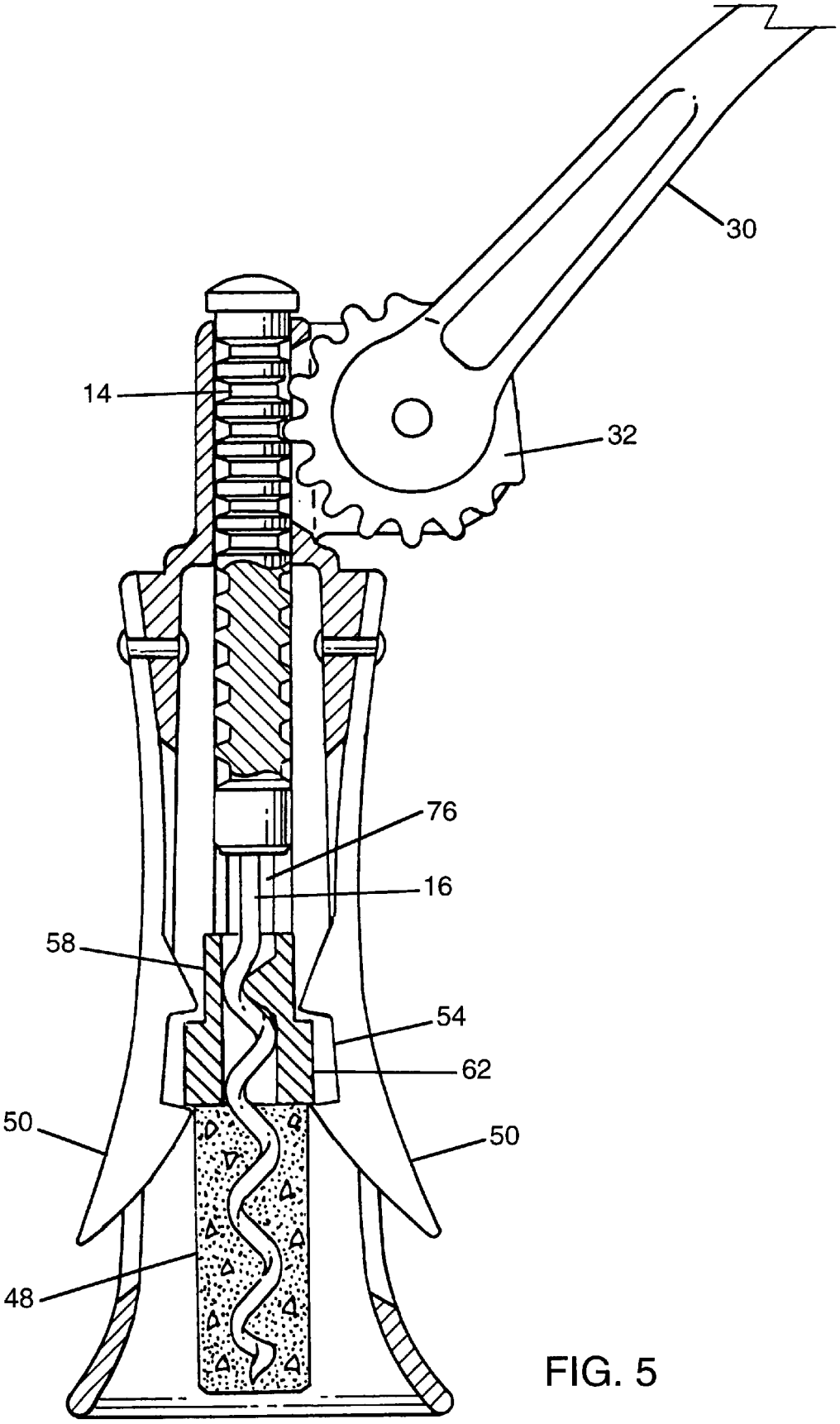
FIG. 5 is a partial elevational view showing the handle up and the cam collar-locked prior to removal of the cork.

When the cork is free of the bottle, the extractor is removed from the bottle, whereupon the fingers flex back to their normal positions. Once again, the handle is rotated to the up position, as shown in FIG. 5 to cause the cam collar 58 to descend whereby the flange 62 snaps into the notches 54 of the fingers.

Figure 6:
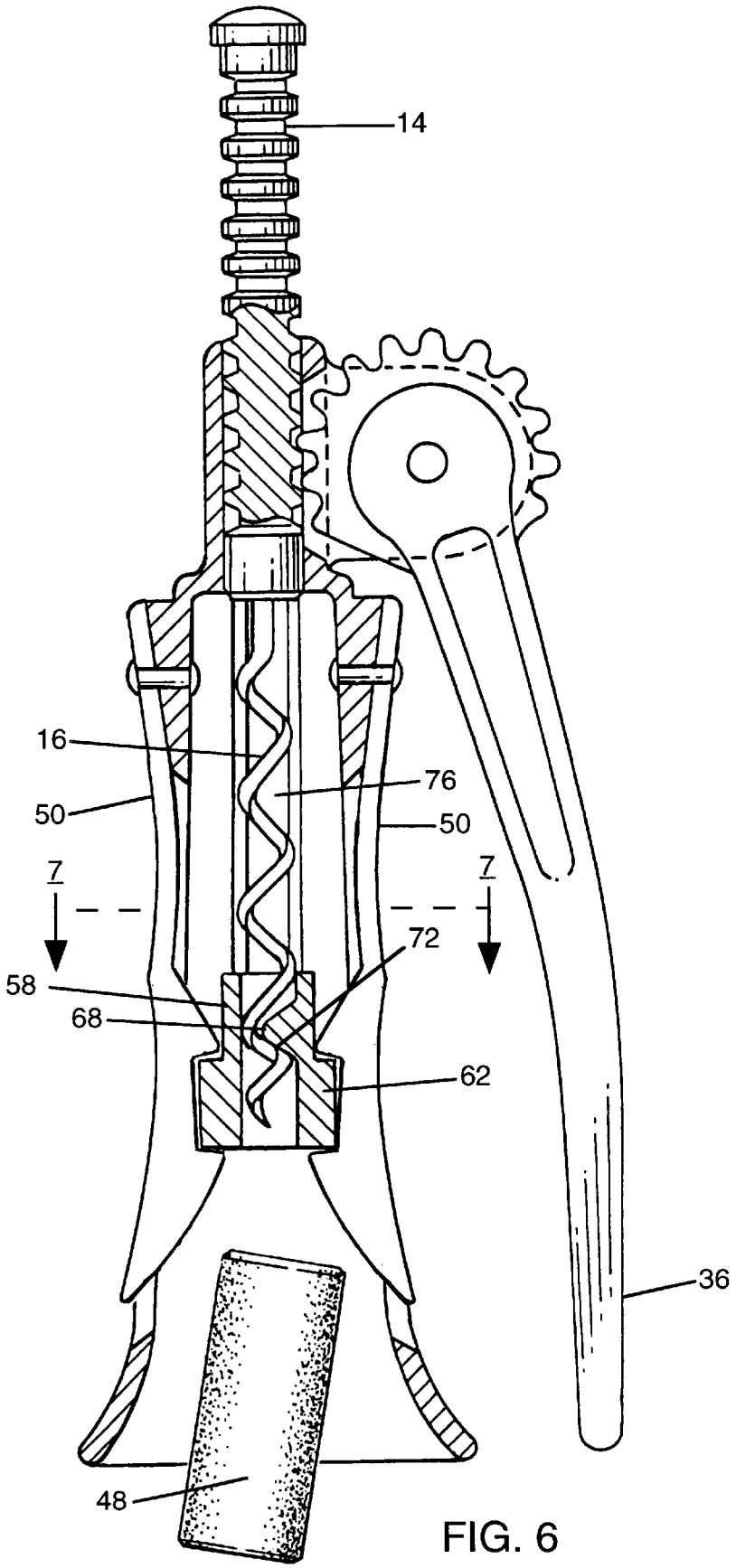
FIG. 6 is a partial elevational view of the device in the cam-locked position with the handle down and the cork removed.

The final step is shown in FIG. 6 and consists of returning the handle to the lowered position. This serves to thread the corkscrew out of the cork. As the handle 36 is rotated down, it causes the gear rack 14 and corkscrew 16 to move vertically away from the cork 48. The surface of the corkscrew contacts the second beveled surface 72 of the cam follower 68 causing the corkscrew to spiral in the reverse direction thereby facilitating its removal from the cork. Inasmuch as the cam collar 58 is latched against vertical movement, the cam collar 58 and thus the cork are restrained from upward vertical movement as the cork is unthreaded from the corkscrew.

Referring now to FIG. 7, the placement of the cam collar 58 within the vertical passageway 24 of the housing 12 is clarified. The cam collar includes an annular passageway 66, partially intercepted by the cam follower 68. The cam collar includes a first set of opposed projections 60 which are vertically movable in the key ways 76 in the vertical passageway 24. The second set of projections 62 engage the notches of the fingers (not shown). The housing include the vertical slots 13 to receive the fingers.

FIGS. 2 through 6 show one embodiment of the corkscrew joined to the gear rack whereupon the corkscrew and the rack rotate as a unit as the cam follower imparts a rotating movement to the corkscrew.

Figure 9:
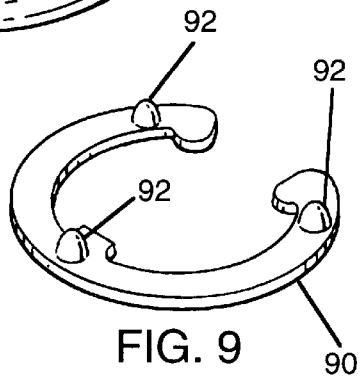
FIG. 9 is an enlarged perspective view showing details of the E-ring clip in FIG. 8.
Figure 8:
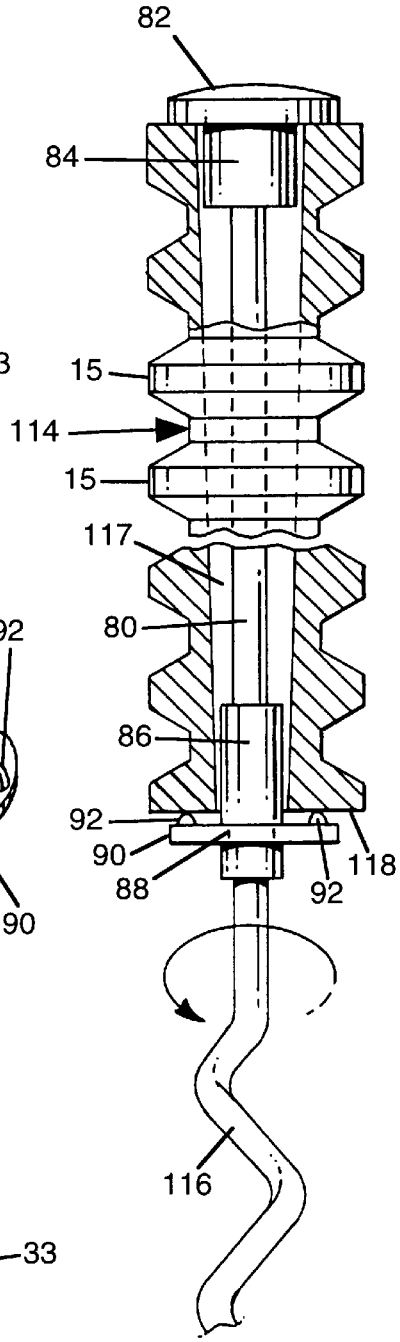
FIG. 8 is a partial cross-sectional view of the gear rack and a free rotating corkscrew.

FIG. 8 shows another arrangement wherein the corkscrew 116 turns independently of the gear rack 114 as the cam follower imparts rotary motion to the corkscrew. The corkscrew is embedded in the lower end of a rod 80 which extends through a tapered annular passageway 117 in the gear rack. The rod 80 includes an enlarged head 82, a first neck 84 joined to the head, and a second neck 86 at the opposite end of the rod. The two necks are sized to permit the rod to rotate within the gear rack. A circumferential groove 88 below the gear rack receives a spring clip 90 such as an E clip which serves as a retainer and a thrust washer. The clip has an outer diameter that is larger than the annular passageway 117 through the gear rack. The passageway 117 preferably is tapered to facilitate injection molding of the gear rack and extraction of the same from the mold. As shown in FIG. 9, at least two and preferably three cones 92 extend up from the surface of the spring clip 90 to form a low friction surface between the clip and the bottom 118 of the gear rack thereby permitting the corkscrew to rotate relative to the gear rack notwithstanding opposed axial pressure between the clip and the gear rack. These cones preferably are molded into the clip, but they can also be molded into the bottom of the rack extending down into contact with the clip. Typically there is sufficient clearance of about 1 mm between the cones and the adjacent surface of the rack to permit limited relative axial movement between the corkscrew and the gear rack. The corkscrew and the gear rack can be simply assembled by inserting the corkscrew and rod through the top of the rack until the head of the rod abuts the gear rack. The spring clip is then snapped into the groove thereby prohibiting separation. Instead of the cones, it is contemplated that other low friction contacts such as thrust or ball bearings, or a suitable lubricant, may be used.

Figure 10:
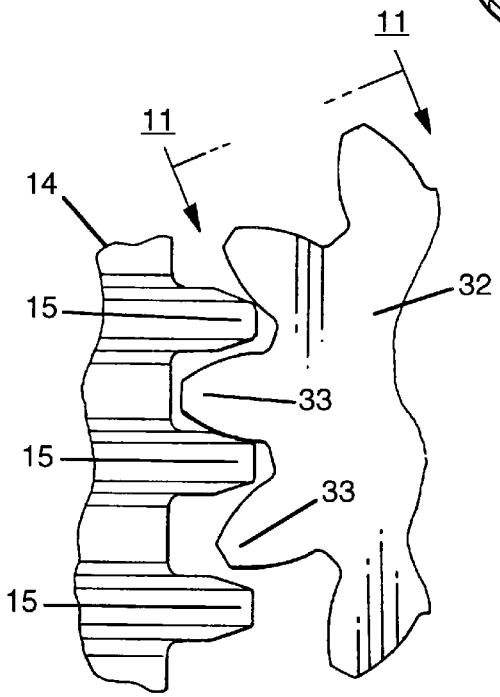
FIG. 10 is an enlarged partial view of the gear teeth meshing with teeth on the gear rack showing single tooth engagement.
Figure 11:
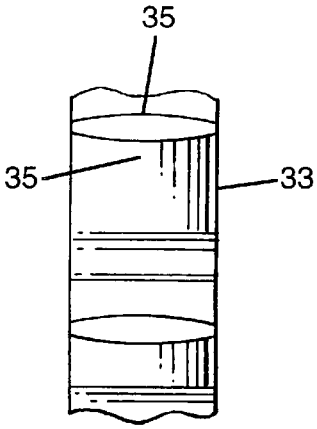
FIG. 11 is a view of the semi-circular gear taken along lines 11—11 of FIG. 10.

FIGS. 10 and 11 show in greater detail, the relationship between the teeth of the semi-circular gear 32 and the corresponding circumferentially extending teeth of the gear rack 14. To minimize the effects of friction during the rotation of the gear rack and its simultaneous reciprocation within the housing, the meshing of the gears is preferably limited to a single tooth 33 of the semi-circular gear 32 contacting a singular groove between adjacent gears 15 of the gear rack 14. A further frictional reduction is achieved by providing each of the teeth 33 on the gear with a slight convex curvature in the axial direction as shown at 35 in FIG. 11.

Figure 12:
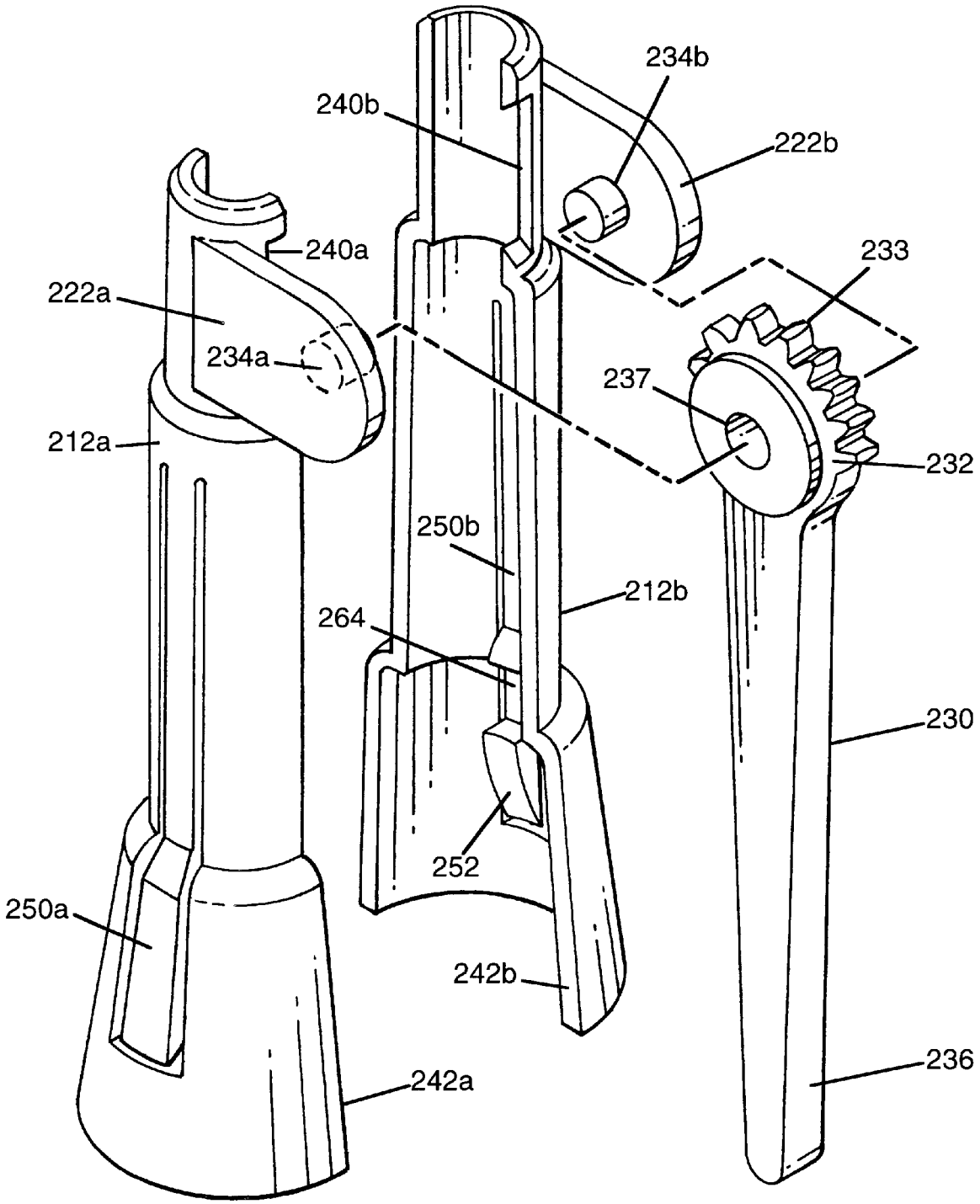
FIG. 12 is a perspective view of an alternative embodiment of the housing and lever.

FIG. 12 shows additional variations of the device of the present invention. The housing is molded or otherwise formed into two separate parts, 212*a*, 212*b*, each of which includes a lug 222*a*, 222*b*. Integrally molded into each lug is a metal or polymeric stub axle or pin 234*a*, 234*b* which cooperates with the corresponding stub axle or pin on the counterpart lug to form a pivot to support the semi-circular gear. Fingers 250*a*, 250*b* are integrally molded or otherwise formed into the two halves of the housing, Each finger includes a curved and beveled surface 252 and a notch 264 which function in the same manner as previously described. The bottom 242*a*, 242*b* of each half of the housing is outwardly flared to facilitate engagement with the mouth of the bottle. The two halves of the housing are joined, with the lever 230 and handle 236 positioned so that the two stub axles 234*a*, 234*b* extend through the axial hole 237 in the semi-circular gear 232. The periphery of the gear extends into the housing through a slot formed by the mating of notches 240*a*, 240*b* The corkscrew, gear rack and cam collar (not shown) are positioned in the housing with the teeth 233 on the semi-circular gear engaging the teeth of the gear rack. The halves of the housing are bonded together using an adhesive, ultrasonic welding, heating or a combination thereof. To facilitate the molding and assembly of the two halves of the housing, the fingers are positioned 90 degrees around the axis of the housing relative to the lugs and the lever. This embodiment also results in the elimination of the separate steps of riveting or otherwise securing the fingers to the housing, and the insertion of a pivot pin to secure the lever between the housing lugs. The embodiment shown in FIG. 12 is fully functional while consisting of only four separate components: a housing, a lever/handle with a semi-circular gear, a cam collar and a gear rack/corkscrew helix.

It should further be noted that the fingers can be integrally molded into the body of the housing in the embodiment shown in FIG. 1, rather than being secured by mechanical means.

The corkscrew useful in the present invention typically is made from spring steel and is burnished and buffed to remove burrs and rough surfaces. A low friction coating of a polytetrafluoroethylene polymer or a silicone may be applied to the surface of the corkscrew to facilitate the entry of the corkscrew into the cork and removal therefrom. Although the other component parts can be fabricated from a suitable structural polymer such as Teflon, Delrin, nylon, polypropylene or polycarbonate, they likewise can be made from a suitable metal such as stainless steel or aluminum. The device typically is manually actuated, although other means of operation such as mechanical or servo-pneumatic, are likewise contemplated as being within the scope of the present invention.

While the invention has been described in combination with embodiments thereof, it is evident that many alternatives, modifications and variations of the foregoing teachings will be apparent to those skilled in the art. Accordingly, the invention is intended to embrace all such alternatives, modifications and variations as fall within the spirit and scope of the appended claims.

What is claimed is:

1. A cork extractor comprising:

a) a generally vertically longitudinal housing having an upper portion, and a lower portion comprising an opening and adapted to receive the mouth of a corked bottle, including a plurality of circumferentially-spaced, downwardly facing flexible fingers, the ends of which form an opening adapted to engage the mouth of the bottle;

b) a cam collar within the housing, non rotatable, and vertically movable between a lower latched position and a raised unlatched position, the cam collar having a vertical passageway therethrough and a cam follower positioned in, and intercepting a portion of the passageway;

c) a gear rack above the cam collar vertically movable through the housing between a first position wherein the bottom of the gear rack is spaced vertically above the cam collar and a second position wherein the bottom of the gear rack is contiguous to the collar, the gear rack including a plurality of gear teeth evenly spaced from one another along the length thereof;

d) a lever, one end of which is pivotally joined to the upper portion of the housing about a pivot axis, the lever including a semi-circular gear around the pivot axis engaging the gear teeth of the gear rack, opposite end of which comprises a handle, whereupon pivotal movement of the handle causes rotation of the gear to impart reciprocating movement to the gear rack; and e) a helical corkscrew having an upper end joined to the bottom of the gear rack and a free lower end, said corkscrew aligned with the vertical passageway in the cam collar and engaging the cam follower to thereby impart a rotating motion to the corkscrew as the corkscrew moves linearly through the cam collar into a cork.

2. The cork extractor according to claim 1 wherein the ends of the fingers when relaxed define an opening which is normally smaller than the diameter of the bottle mouth and hold the cam collar in its latched position.

3. The cork extractor according to claim 2 wherein the ends of the fingers each terminate in an inwardly facing beveled surface adapted to contact the mouth of a bottle and to bias the flexible fingers radially outwardly as the fingers are moved downwardly into engagement with the mouth of the bottle thereby causing unlatching of the cam collar.

4. The cork extractor according to claim 3 wherein the housing includes at least one vertically extending key way, and the cam collar includes a key which engages the key way to prevent rotational movement of the cam collar with respect to the housing while permitting vertical movement of the cam collar along the key way.

5. The cork extractor according to claim 3 wherein each of the fingers includes a radially inwardly facing notch, and the cam collar includes a flange which engages the notch when the fingers are relaxed and disengages the notch when the fingers are spread radially apart by engagement with the mouth of the bottle.

6. The cork extractor according to claim 4 wherein the housing includes two radially opposed vertically extending key ways, and the cam collar includes two keys, each of which engages one of the key ways.

7. The cork extractor according to claim 1 wherein pivotal movement of the handle through an arc of between about 120° and about 180° produces sufficient linear movement of the gear rack to fully extract a cork from a bottle.

8. The cork extractor according to claim 7 wherein the pivotal movement of the handle through an arc between about 150° and about 180° produces sufficient linear movement to extract the cork.

9. The cork extractor according to claim 7 wherein the handle is pivoted from a lowered position to a raised position to drive the free lower end of the corkscrew helically downwardly into the cork.

10. The cork extractor according to claim 9 wherein the corkscrew is secured to the gear rack to prevent relative rotation therebetween, and the gear rack is freely rotatable within the housing.

11. The cork extractor according to claim 9 wherein the corkscrew is pivotally joined to the gear rack to permit rotation of the corkscrew independently of the gear rack.

12. The cork extractor according to claim 7 wherein the handle is pivoted from a vertically raised position to a vertically lowered position to withdraw the cork from the bottle into the housing.

13. The extractor according to claim 1 wherein the vertical passageway through the cam collar is cylindrical and the cam follower includes a first bearing surface extending into the vertical passageway into contact with the helical surface of the corkscrew as the corkscrew is spirally driven in to the cork.

14. The cork extractor according to claim 13 wherein the cam follower includes a second bearing surface intercepting the vertical passageway in contact with the corkscrew as the cork is removed from the corkscrew.

15. The cork extractor according to claim 14 wherein the first and second bearing surfaces of the cam follower converge to form a rounded apex.

16. The cork extractor according to claim 15 wherein the cam follower extends into the vertical passageway a distance of between about ½ and about ⅔ of the diameter of the passageway.

17. The cork extractor according to claim 1 wherein the upper portion of the housing includes a pair of lugs offset from the axis of the gear rack and the lever is pivotally secured between the lugs.

18. The cork extractor according to claim 1 wherein the corkscrew forms a barrel cam helix of less than about 45°.

19. In a cork extractor comprising a housing having a generally bell-shaped opening including a plurality of downwardly extending fingers adapted to engage the mouth of a bottle, a cam collar within the housing being vertically movable but not rotatable within the housing, the cam collar including a cam follower, and a helical corkscrew vertically movable within the cam collar, the improvement comprising a gear rack joined to the upper end of the corkscrew and being vertically and rotatably movable within the housing, the gear rack being positioned above and axially aligned with the cam collar, and a semi-circular gear engaging the gear rack whereupon rotation of the semi-circular gear imparts reciprocating movement to the gear rack.

20. In the cork extractor according to claim 19, the semi-circular gear joined to one end of an elongated lever and having a handle at the other end.

21. In the cork extractor of claim 19, the gear rack containing a plurality of evenly spaced, discrete gear teeth along the length thereof.

22. In the cork extractor of claim 21, the gear rack being freely rotatable and the gear teeth extending circumferentially around the rack.

23. In the cork extractor of claim 22, the teeth on the semi-circular gear and the gear rack having a convex curvture in the axial direction whereby the contact at any given time between the teeth on the semi-circular gear and the teeth on the gear rack being limited to a single tooth contact.

24. In the cork extractor of claim 21, the corkscrew being joined to the gear rack to be independently rotatable with respect to said gear rack.

25. In the cork extractor of claim 24, the gear rack having an annular passageway therethrough, one end of the corkscrew being secured to a rod extending through the annular passageway, the rod having a retaining cap at the upper end of the gear rack and a circumferential slot below the lower end of the gear rack, a retainer clip disposed in the slot to limit vertical movement but not rotational movement of the corkscrew with respect to the gear rack.

26. In the cork extractor according to claim 25, the retainer clip including a plurality of cones spaced from one another in contact with the bottom of the gear rack to provide low friction contact surfaces to facilitate relative rotation of the corkscrew with respect to the gear rack.

27. In the cork extractor of claim 26, the rod being integrally molded to the upper end of the corkscrew.

28. In the cork extractor according to claim 20, the semi circular gear having a diameter which moves the gear rack a linear distance sufficient to fully extract a cork from a bottle upon movement of the handle through an arc of between about 120° degrees and about 180° degrees.

29. In the cork extractor according to claim 20 the housing including a pair of lugs, the gear at one end of the handle being pivotally secured between the lugs, and engaging the gear rack through a vertical slot in the housing.

30. In a cork extractor comprising an elongated housing having a generally bell-shaped opening at one end adapted to engage the mouth of a corked bottle, and a plurality of elongated slots, a gear rack movable along the axis of the housing, a lever pivotally connected to the other end of the housing and including a semi-circular gear engaging the gear rack, and a corkscrew joined to the gear rack, the improvement comprising a flexible finger disposed in each elongated slot adapted to engage the mouth of the corked bottle, and a cam collar axially but not rotationally movable within the housing between a first position in proximity with the mouth of the bottle and a second position spaced a sufficient distance from the first position to permit the cork to be fully extracted from the bottle, each of the fingers having latching means and the collar having latch engaging means.

31. In the cork extractor according to claim 30, each latching means comprising a notch and the latch engaging means comprising a lateral projection in the cam collar to engage each notch to prevent vertical movement of the cam collar.

32. In the cork extractor according to claim 31, the fingers including a beveled surface adapted to contact the mouth of a bottle and to bias the flexible fingers radially outwardly as the fingers are urged around the mouth of the bottle thereby causing the cam collar to be disengaged from the notches.

33. In the cork extractor according to claim 32 including two flexible fingers, the latch engaging means on the cam collar comprising two lateral projections, each projection engaging the notch in a corresponding finger.

34. In the cork extractor according to claim 32, the beveled surface of each finger having a concave surface corresponding to the curvature of the mouth of the bottle.

35. In the cork extractor according to claim 30, the cam collar including at least one vertically extending key and the housing containing a corresponding key way engaged by the key to permit the cam collar to move vertically, but not rotationally, within the housing.

36. In the cork extractor according to claim 30, the fingers being integrally molded into the housing.

37. In the cork extractor according to claim 30, one end of the fingers being joined to the housing by mechanical fastening means.

* * * * *